US005366148A

United States Patent [19]

Schreckengost

[11] Patent Number: 5,366,148

[45] Date of Patent: Nov. 22, 1994

[54] MAILBOX AND SIGNAL

[76] Inventor: Harold C. Schreckengost, 233 Parallel St., Pleasantville, Pa. 16341-9752

[21] Appl. No.: 26,608

[22] Filed: Aug. 23, 1993

[51] Int. Cl.[5] ..... B65D 91/00

[52] U.S. Cl. ..... 232/35

[58] Field of Search ..... 232/34, 35; 292/340; 411/513, 515

[56] References Cited

U.S. PATENT DOCUMENTS

| | | | |
|---|---|---|---|
| 2,433,940 | 1/1948 | Weaver | 232/35 |
| 3,482,543 | 2/1969 | Guidos | 116/132 |
| 3,596,631 | 8/1971 | Sutton | 232/35 |
| 3,866,823 | 2/1975 | Grayson | 223/35 |
| 4,138,056 | 2/1979 | Sherrill | 232/35 |
| 4,995,330 | 2/1991 | Likens | 232/34 |
| 5,076,337 | 12/1991 | Reuter | 160/35 |
| 5,123,590 | 6/1992 | Teele | 232/35 |

*Primary Examiner*—Michael J. Milano

*Attorney, Agent, or Firm*—Lovercheck and Lovercheck

[57] ABSTRACT

A mailbox having a door and a signal device to indicate that the door has been opened when a mail carrier puts mail in the mailbox. The signal is urged to and held in an erect position by a helical spring fixed to a side of the mailbox at one end and having a rigid staff inserted in the other end of the helical spring. The door is hinged to the mailbox at its bottom to swing from a vertical to a horizontal position. Cotter pins are provided to support the signal on the box and on the door. Each cotter pin has legs that extend through a hole in the mailbox and in the door. Each cotter pin has a ring on it that receives the signal. One of the cotter pins is attached to the door. When the door is opened the ring moves with the door and off the end of the staff thereby releasing the staff and allowing the helical spring to swing the staff to an erect position. A rectangular template is provided for forming holes in the mailbox and door for the cotter pins. A flag may be attached to the staff.

6 Claims, 1 Drawing Sheet

MAILBOX AND SIGNAL

BACKGROUND OF THE INVENTION

Many mailbox signals have been designed for rural mailboxes for the purpose of rendering a signal visible from a distance showing that mailboxes have been opened, as occurs when a mailman places a mail delivery in the box. These previously designed mailbox signals such as those disclosed in U.S. Pat. No. 3,482,543 to Guidos for a mail box signal flag; U.S. Pat. No. 3,866,823 to Grayson for a rural mailbox signal; U.S. Pat. No. 4,138,056 to Sherrill for a mailbox signal; U.S. Pat. No. 5,076,337 to Reuter for a mail arrival alert for mailbox; and U.S. Pat. No. 5,123,590 to Teele for a mail delivery indicator for a mailbox have complicated mechanisms, required modifications to conventional forms of mailboxes, or required complex mounting structures. None of the above patents show a mailbox with a signal like applicant's.

SUMMARY OF THE INVENTION

The mailbox signal of this invention requires minimum modifications of the associated mailbox, employs only a simple fastening member and includes a simple structure. The mailbox signal is very economically manufactured, may be readily installed by unskilled persons and may be readily mounted on existing mailboxes without modifications thereto.

Another object of this invention is to provide an improved mailbox signal which may be readily mass produced at a very low cost.

Still another object of the present invention to provide a mailbox signal whose structural features will afford a maximum life.

A further object of this invention is to provide a mailbox signal that may be readily operatively mounted upon conventional mailboxes.

A final object of this invention is to provide a mailbox signal in accordance with the preceding objects which will conform to conventional forms of manufacture, be of simple construction and easy to use so as to provide a device that will be economically feasible, long lasting and relatively trouble free in operation.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
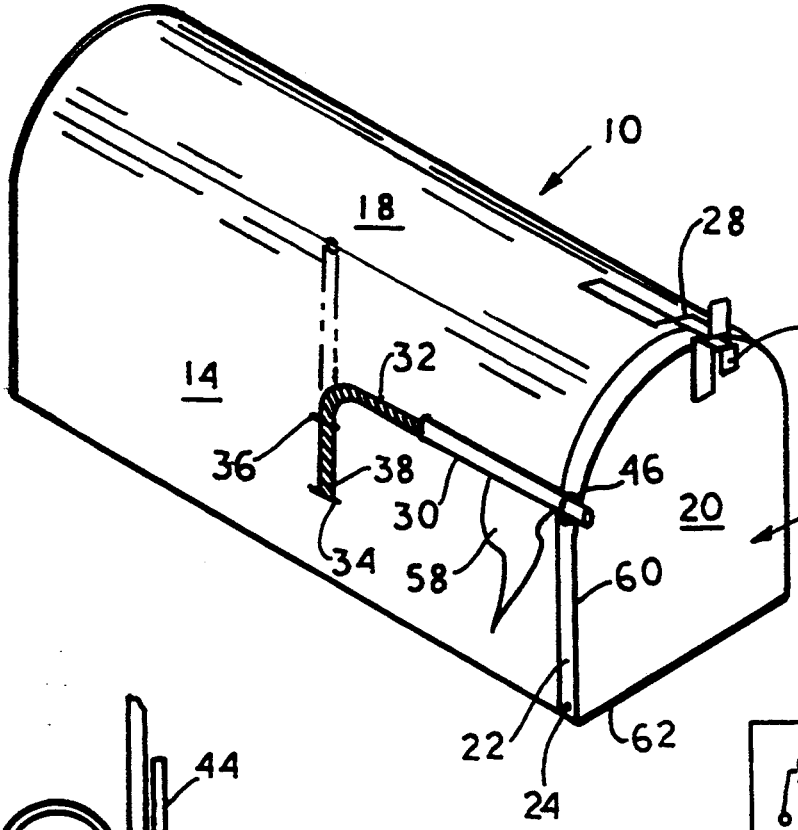
FIG. 1 is an isometric view of the mailbox and signal system according to the present invention.
Figure 2:
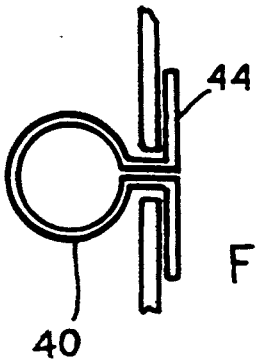
FIG. 2 is a cross sectional view taken on line 2—2 of FIG. 1.
Figure 4:
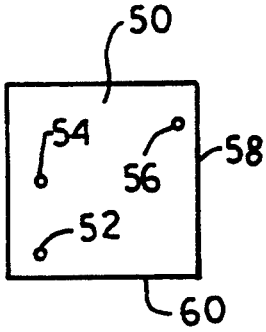
FIG. 4 is a view the template for locating the holes in the mail box when installing the signal system.

Now with more particular reference to the drawings, shown is a combination of mailbox 10 and signal 12. Mailbox 10 has sides 14, door 16 and top 18. Door 16 has plate-like front 20 with flange 22 disposed at right angles to door front 20. Door 16 is hinged to mailbox 10 by horizontal hinge 24 at a lower part of sides 14. Door 16 has latch 26, which cooperates with latch part 28 on mailbox top 18 to hold door 16 in a closed position.

Staff 30 may be tubular with an inside diameter that is slightly smaller than the outside diameter of helical spring 32. Spring 32 is received in hollow lower end 37 of staff 30, so that staff 30 is held firmly in place. Staff 30 is held in an erect position by spring 32 as shown in phantom lines in FIG. 1.

Helical spring 32 is held to side 14 of mailbox 10 by means of first cotter pin 34 and second cotter pin 36. Lower end 38 of spring 32 is received in ring 40 of first cotter pin 34. Intermediate part 42 of spring 32 is received in ring 40 of second cotter pin 36. Legs 44 of cotter pins 34 and 36 extend through side 14 of mailbox 10 and are clinched on the inside by having legs 44 bent away from one another. Legs 44 of third cotter pin 46 extend through flange 22 and are clinched on the inner side of flange 22 by having legs 44 bent away from each other.

Figure 3:
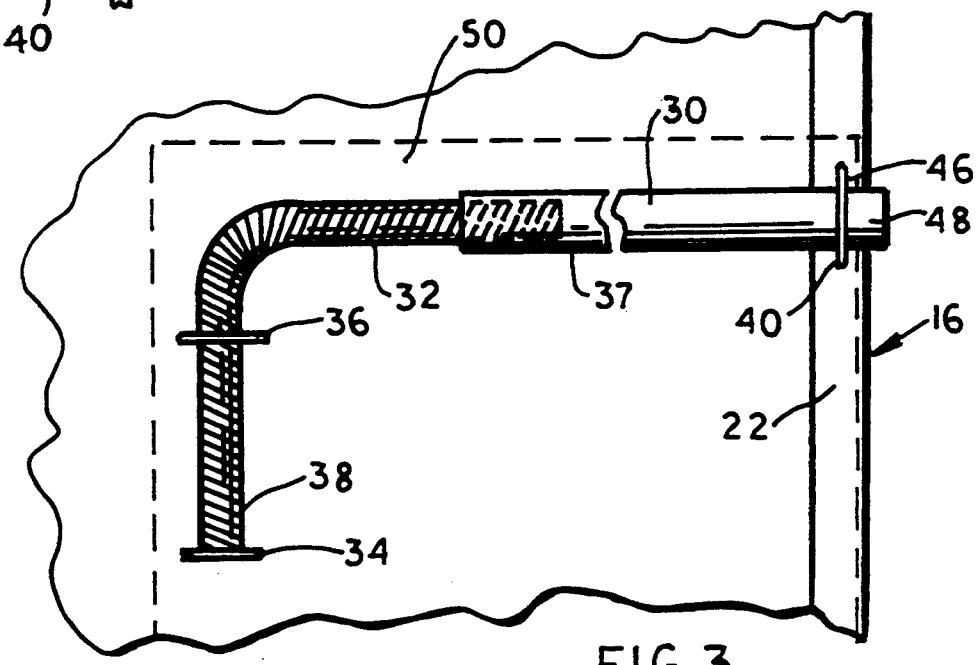
FIG. 3 is a partial enlarged view of FIG. 1.

When mailbox 10 is in use between mailings, staff 30 is swung down and forward to a position as shown in FIGS. 1 and 3 with distal end 48 extending through ring 40 of third cotter pin 46.

When a mail carrier delivers mail, he or she will swing door 14 to the open position. Ring 40 of third cotter pin 46 will be carried with door 16 and will be move off from distal end 48 of staff 30 allowing spring 32 to swing staff 30 to an erect position, indicating that mail has been delivered. The mail carrier will then close door 16. A person may then open door 16, remove the mail, swing door 16 to its closed position while holding staff 30 in the horizontal position so that the distal end of staff 48 will enter ring 40 on third cotter pin 46. Signal 12 will then be held in position to receive the next mail delivery.

Template 50 is made of a rectangular shaped sheet of relatively rigid material such as cardboard, plastic metal or the like. Holes 52,54,56, are formed in template 50 and are adapted to receive a drill or the like to form or drill holes for cotter pins 34,36,46. Template 50 is used by supporting mailbox 10 on a flat surface, resting lower edges 60 of template 50 on the flat surface with front edge 66 flush with edge 62 of door 16. Holes may then be drilled or otherwise formed in the mailbox 10 to receive cotter pins 34,36,46 by using holes 52,54,56 of template 50 as a guide for a drill bit or some other tool. Thus, the signal kit is easily installed on an existing mailbox.

Flag 58 may be supported on staff 30. Flag 58 may have any suitable message thereon, such as "MAIL IS HERE", or some other suitable wording. This message will be clearly visible to a viewer at a considerable distance from mailbox 10.

I claim:

1. In combination a mailbox and a signal;

said mailbox having a side, a door and a hinge means connecting said door to said mailbox;

said signal comprising a staff having a lower end and an upper end, a helical spring attached to said lower end of said staff, a first attaching means and a second attaching means;

said first attaching means and said second attaching means attaching said helical spring to said side of said mailbox;

a third attaching means comprising a cotter pin having a ring and legs;

said staff being adapted to be swung to a generally horizontal position with said upper end of said staff received in said ring whereby said staff is held in generally horizontal position by said ring;

said staff being adapted to be urged to a generally vertical position by said helical spring indicating that mail has been delivered when said door is opened moving said ring off said staff;

said legs are fixed to said ring and extending through a flange on said door.

2. The combination recited in claim 1 wherein said second attaching means comprises a second cotter pin having a second ring receiving an intermediate part of said spring and having legs extending through said mail box.

3. The combination recited in claim 2 wherein said first attaching means comprises a first cotter pin having a first ring receiving a lower end of said spring holding said lower end of said spring, and legs on said first ring extending through a wall of said mailbox holding said lower end of said spring to said mailbox; and, said first attaching means is adapted to receive a lower end of said spring thereby holding said spring to said mailbox.

4. The combination recited in claim 1 wherein said staff is tubular and said helical spring is received in an end of said staff; and, said helical spring being securely attached to said mailbox.

5. The combination recited in claim 1 wherein said staff is tubular and said helical spring has an end telescopically received in said staff and slidable therein whereby the effective length of said staff can be adjusted.

6. A method of applying a signal to a mailbox having a side and a door, comprising providing a signal having an elongated staff terminating in a helical spring;

supporting a template comprising a flat sheet of material having spaced openings therein adjacent said mailbox for locating holes in said mailbox and in said door by using said spaced openings of said template to locate a drill or the like;

drilling said holes in said mailbox for receiving attaching means for said spring and said staff;

attaching said spring to said mailbox; and, attaching a cotter pin having a ring to said door; and, said ring being adapted to receive an end of said staff whereby said staff is held in a generally horizontal position.

* * * * *